United States Patent [19]

Cowan

[11] 4,451,170

[45] * May 29, 1984

[54] APPARATUS FOR CONNECTING A TENSION MEMBER TO AN UNDER-WATER ANCHORING BASE

[75] Inventor: William S. Cowan, West University Place, Tex.

[73] Assignee: Armco Inc., Middletown, Ohio

[ * ] Notice: The portion of the term of this patent subsequent to Feb. 21, 2001 has been disclaimed.

[21] Appl. No.: 404,812

[22] Filed: Aug. 3, 1982

Related U.S. Application Data

[63] Continuation of Ser. No. 192,709, Oct. 1, 1980, abandoned.

[51] Int. Cl.[3] ..... F16D 3/00

[52] U.S. Cl. ..... 403/57; 114/265; 405/202

[58] Field of Search ..... 403/57, 58, 326, DIG. 6; 64/7; 9/8; 441/23; 114/265, 293, 264; 405/202, 224; 285/307, 321

[56] References Cited

U.S. PATENT DOCUMENTS

| | | | |
|---|---|---|---|
| 2,877,732 | 3/1959 | Eaton | 285/321 X |
| 3,345,084 | 10/1967 | Hanes et al. | 285/321 X |
| 3,345,085 | 10/1967 | Hanes et al. | 285/321 X |
| 4,111,464 | 9/1978 | Asano et al. | 285/321 X |
| 4,155,670 | 5/1979 | Stafford | 405/202 |
| 4,212,561 | 7/1980 | Wipkink | 405/202 X |
| 4,319,773 | 3/1982 | Lawson | 285/321 X |
| 4,320,993 | 3/1982 | Hunter | 114/265 X |
| 4,347,012 | 8/1982 | Glidden | 403/326 X |

*Primary Examiner*—Wayne L. Shedd

*Attorney, Agent, or Firm*—Roylance, Abrams, Berdo & Goodman

[57] ABSTRACT

In apparatus for connecting a tension member, such as an element of a leg of a tension leg platform, to an underwater anchoring base, actual connection to the anchoring base is accomplished by a connector which is joined to the tension element by a flex joint which is spaced above the connector but surrounded by a tubular element rigid with the anchoring base, the flex joint carrying an annular stop surface which is closely embraced by the tubular element. Lateral loads applied to the flex joint by the tension element are transferred directly to the tubular element and the anchoring base rather than to the connector.

14 Claims, 8 Drawing Figures

APPARATUS FOR CONNECTING A TENSION MEMBER TO AN UNDER-WATER ANCHORING BASE

This application is a continuation of application Ser. No. 192,709, filed Oct. 1, 1980, now abandoned.

This invention relates to apparatus for connecting an elongated tension element, such as a pipe string forming one element of a leg of an offshore tension leg platform, to an underwater structure, such as an anchoring base at the floor of a body of water, and to installations embodying such apparatus.

RELATED APPLICATIONS

This application discloses remotely operated underwater tension connectors which are disclosed and claimed in copending application Ser. No. 170,970, filed July 18, 1980, by Edward M. Galle, Jr. Combined connectors and flex joints of the type disclosed in this application are disclosed and claimed in application Ser. No. 192,739, filed concurrently herewith by John E. Lawson, now U.S. Pat. No. 4,319,773. Certain fasteners disclosed herein are disclosed and claimed in copending application Ser. No. 120,046, filed Feb. 11, 1980, by John E. Lawson.

BACKGROUND OF THE INVENTION

The need for drilling and completing oil and gas wells offshore in increasing numbers and at increasing depths has accentuated the problem of installing tension elements in the nature of strings of pipe extending from, e.g., a platform at the surface to, e.g., an anchoring base on the ocean floor, with the tension element being capable of withstanding the large lateral forces applied by water currents and waves, yet being readily retrievable by remote manipulations without the aid of divers. One specific example of such installations is presented by the tension leg platform in which each of a plurality of legs may involve, e.g., three tension elements each in the form of a string of pipe, with each tension element capable of withstanding a tension load in excess of 6 million pounds. Such platforms are disclosed, for example, in U.S. Pat. Nos. 3,648,638 to Blenkarn, 3,654,886 to Silverman, 3,976,021 to Blenkarn et al, 3,955,521 to Mott and 3,996,755 to Kalinowski. Though no tension leg platform has yet been installed, it appears to be accepted by prior-art workers contemplating such installations that each elongated tension element must be equipped with a flex joint at the lower end of the tension element and with a flex joint at the upper end of the tension element to allow lateral displacement of the tension element, due to action of waves and currents, without overstressing the end connections. Thus, during early planning for tension leg platforms, prior-art workers appear to have been content merely to specify that each tension element must be connected to an anchoring base by a remotely operated connector, so that initial connection of the tension element to the anchoring base can be accomplished from the surface and the tension element can subsequently be disconnected and recovered for periodic inspection, and that a flex joint be installed in the tension element adjacent the connector. However, in arriving at a feasible actual embodiment of the tension leg and connector, it has been discovered that merely providing both a connector and a flex joint cannot answer the problem satisfactorily because the lateral forces and bending moments would be applied via the flex joint to the mating load-bearing surfaces of the connector.

OBJECTS OF THE INVENTION

Accordingly, a general object of the invention is to provide appartus for connecting an elongated element in tension to, e.g., an anchoring base in such fashion that, while full use of a flex joint is afforded, the application of lateral forces via the flex joint to the active surfaces of the connector is at least minimized.

Another object is to provide such apparatus in which presence of the flex joint does not interfere with remote operation of the connector.

A further object is to devise simple and inexpensive means for transferring lateral loads to, e.g., the anchoring base in parallel with, rather than through, the active components of the connector.

SUMMARY OF THE INVENTION

Apparatus according to the invention includes a connector for connecting the tension element to the fixed underwater structure. The connector includes a male connector unit, a female connector unit and connector means for securing the two connector units together against tension, one of the connector units being connectable to the pipe string or other elongated tension element, the other connector unit being connectable to the anchoring base or other fixed underwater structure. The connecting means comprises a shoulder on one of the connector units and generally annular stop means carried by the other connector unit, the stop means and shoulder being mutually engageable to prevent upward movement of the elongated tension element when the male and female connector units are in predetermined relative positions. The apparatus further comprises rigid generally tubular means, which can be part of the female connector unit when the female unit is the one of the connector units secured to the underwater structure, the rigid generally tubular means surrounding at least a portion of a flex joint means which connects the tension element to the connector. The flex joint means includes a first flex joint member connectable to the connector unit, a second flex joint member connectable to the elongated tension element, universal joint means interconnecting the two flex joint members to transmit tension loads therebetween, and rigid means carried by the flex joint means and presenting a generally annular stop surface which surrounds the flex joint means, is spaced above the connector means and is dimensioned and positioned to be closely embraced by the bore wall portion of the rigid generally tubular means when the shoulder and stop means of the connector means are mutually engaged.

Provision of the stop surface of the flex joint means and the bore wall portion which surrounds the stop surface when the connector means is made up prevents the connector unit which is joined to the tension element from shifting significantly, either in a tilting mode or in simple lateral movement, relative to the other connector unit. Thus, even when heavy lateral loads are applied at the flex joint, the mating surfaces of the shoulder and annular stop means of the connector means can remain in flush engagement, without movement of one surface relative to the other occuring as a result of lateral loads or bending moments applied to the connector via the flex joint.

Advantageously, the axial space between the stop surface of the flex joint and the connecting means, when the connector is made up, is large relative to the axial dimensions of the stop means and shoulder of the connector means, and the diametrical fit of the stop surface of the flex joint means and the surrounding bore wall portion is as snug as is practical in view of the fact that the flex joint means and attached connector unit must be inserted into the bore wall portion. It is also advantageous to equip that connector unit which is attached to the elongated tension element with a second generally annular stop surface which is spaced below the connector means when the connector is made up, and to provide a second bore wall portion to surround the second stop surface, so that any lateral shifting or tilting of the connector unit which is attached to the tension element is stopped at the outset by both stop surfaces. While the upper annular stop surface can be mounted in a number of ways, it is particularly advantageous to have that surface carried as directly as possible by that one of the flex joint members which is attached to the connector unit.

IDENTIFICATION OF THE DRAWINGS

In order that the manner in which the foregoing and other objects are achieved can be understood in detail, particularly advantageous embodiments of the invention will be described with reference to the accompanying drawings, which form part of the original disclosure of this application, and wherein.

DETAILED DESCRIPTION

The Problem Solved By The Invention

Figure 1:
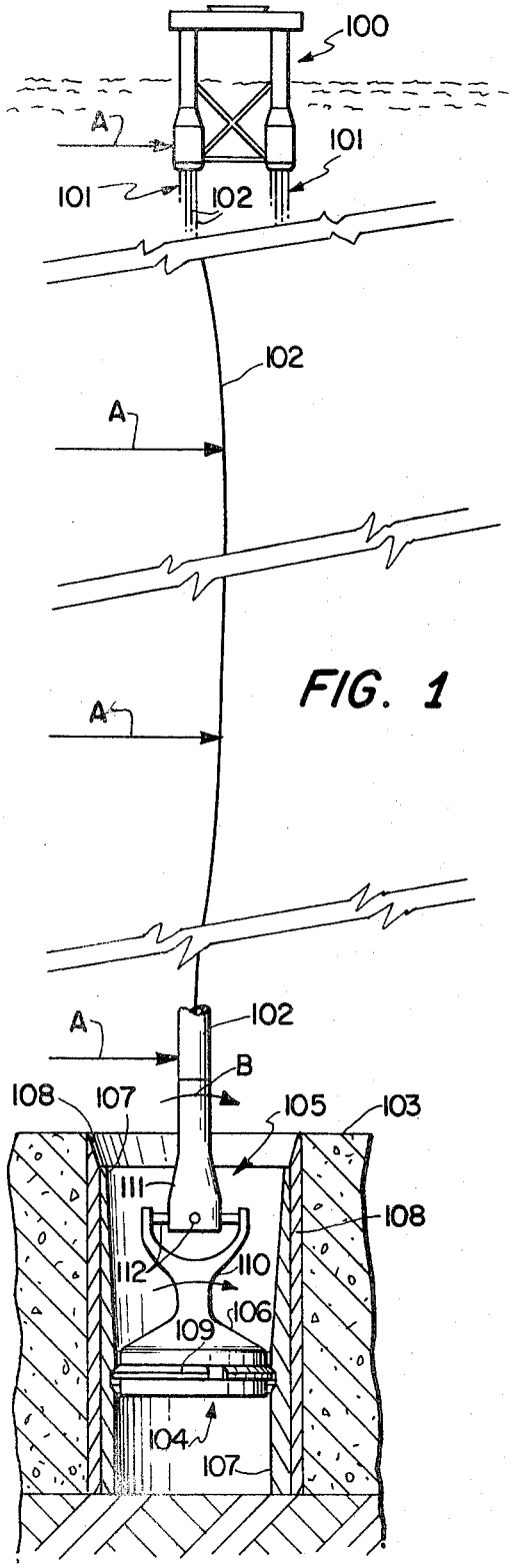
FIG. 1 is a semi-diagrammatic illustration of one type of offshore installation to which the invention can be applied.

Though the invention is applicable to any installations in which a string of pipe, or other elongated tension element, extends generally downwardly to the floor of a body of water and is there attached to a fixed underwater structure, tension leg platforms such as that illustrated in FIG. 1 serve well to illustrate the problem solved by the invention. In FIG. 1, the buoyant platform 100 is provided with a plurality of anchoring legs 101 each made up of a plurality of strings of pipe 102, the lower end of each string 102 being secured in tension to an anchoring base 103 by a connector 104, a flex joint indicated generally at 105 being interposed between the pipe string and connector. For purposes of illustration, the connector is shown as being of the general type described in application Ser. No. 170,970, with male connector unit 106 being connected to the pipe string via the flex joint and with the tubular female connector unit 107 secured within a receptacle 108 which in turn is rigidly secured to the anchoring base 103 which may be a concrete structure secured to the ocean floor by piles (not shown). Male connector unit 106 carries a split ring 109 adapted to be received in a transverse annular inwardly opening groove in female unit 107 in such fashion that an upwardly directed surface on the split ring can engage beneath the shoulder which constitutes the upper wall of the groove in the female unit. Thus, when so engaged, the split ring acts as a stop means to prevent upward movement of the male connector unit, and thus of the pipe string, relative to the female unit. For purposes of illustration, flex joint 105 is shown as a simple Hooke's joint, with one flex joint member 110 connected rigidly to male unit 106 and the other flex joint member 111 connected rigidly to the lower end of pipe string 102. Flex joint members 110, 111 are interconnected by universal joint means in the form of crossed shafts 112 with the ends of each shaft 112 journalled in the forked end of a different one of members 110, 111 in the usual manner for a Hooke's joint.

By means of tensioning units on the platform, pipe strings 102 are tensioned equally to draw the platform downwardly against its buoyancy, and strings 102 are accordingly under great tension. Additionally, wave action and the action of underwater currents can apply large lateral forces to the pipe strings, as indicated by arrows A, tending both to move the platform laterally relative to the anchoring base and to bow the pipe string in the manner illustrated in FIG. 1. With the pipe string strongly tensioned, such lateral forces can tend to have periodic as well as constant components and all components of the lateral forces are applied to flex joint member 111. The flex joint accordingly not only flexes continually, to compensate for the angularity resulting from bowing of the pipe string, but also tends to shift laterally relative to the anchoring base. Since flex joint member 110 is rigidly connected to male connector unit 106, and since the male unit is connected to female connector unit 107 only through the mutually engaged surfaces of stop ring 109 and the shoulder of female member 107, in a location spaced well below the flex joint, the force applied via the flex joint to the connector must be viewed as having not only simple lateral components, tending to move the male connector unit off center in the female unit in the direction of arrows A, but also a bending component, illustrated by arrow B, tending to pivot or swing the male connector unit about an axis determined by the interengaged stop ring and shoulders. One marked adverse effect of such lateral forces is thus to displace the interengaged surfaces of ring 109 and the shoulder presented by the female connector unit. Thus, these interengaged surfaces will tend to "work," not only inducing undue wear of the ring and shoulder but also causing the engagement of the surfaces to be less than flush and varying the areas of the surfaces which are in engagement.

The Illustrative Embodiments Shown Semidiagrammatically In FIGS. 2–6

Figure 2:
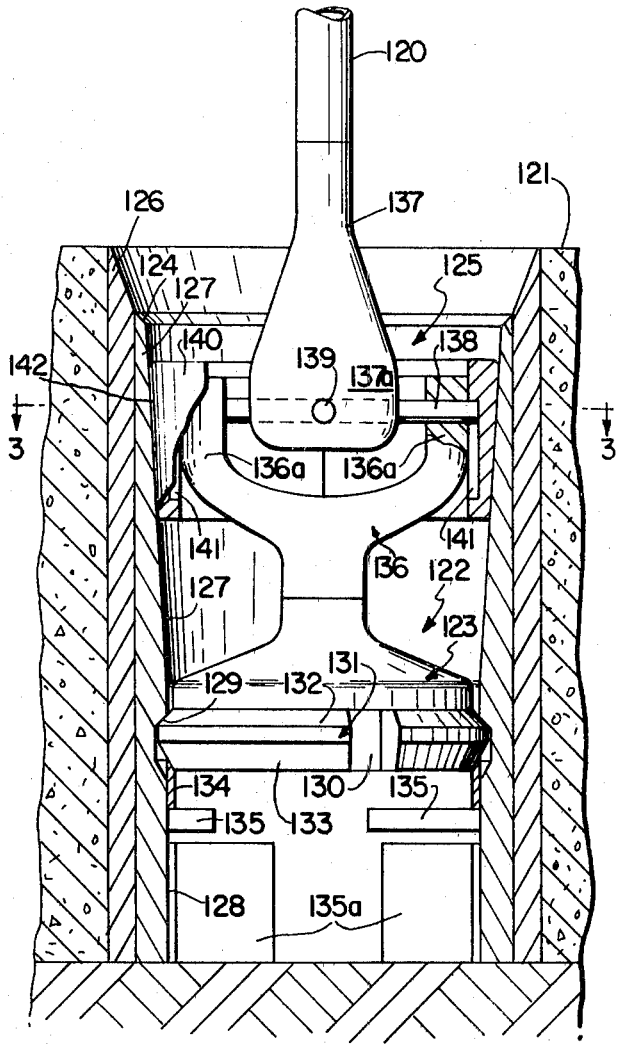
FIG. 2 is a semidiagrammatic view, partly in side elevation and partly in vertical cross section, illustrating one apparatus for connecting a tension element to an underwater structure according to the invention.
Figure 3:
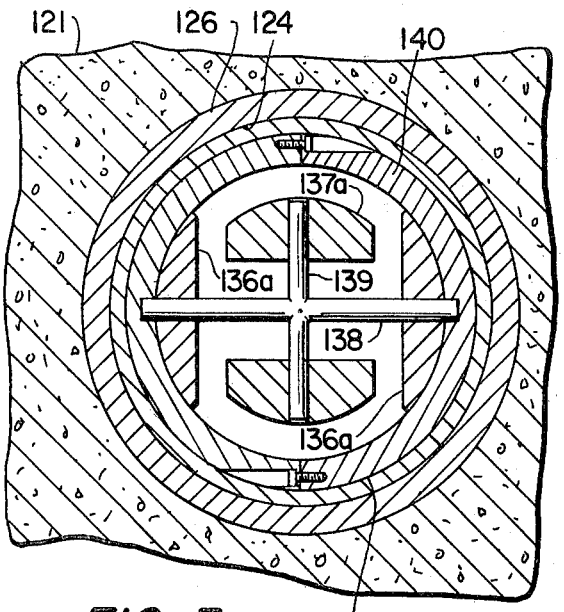
FIG. 3 is a tranverse sectional view taken generally on line 3—3, FIG. 2.

FIGS. 2 and 3 show, in simplified and semidiagrammatic form, with some parts omitted for clarity, an embodiment of the apparatus in which a pipe string 120 can be connected to a fixed underwater structure 121 in the general context of the tension leg platform installation seen in FIG. 1. The apparatus comprises a connector 122 comprising a male connector unit 123 and a tubular female connector unit 124. Male unit 123 is connected to the lower end of pipe string 120 via a flex joint 125, again shown as a simple Hooke's joint. Female unit 124 is embraced by a tubular receptacle 126, the receptacle being disposed in an upright bore in structure 121 and secured rigidly to the structure in any suitable fashion, the female unit in turn being secured rigidly in any suitable fashion to the receptacle. Male unit 123 and female unit 124 are generally as taught in copending application Ser. No. 170,970. The female unit thus has a downwardly and inwardly tapering frustoconical upper bore portion 127 and a right cylindrical bore portion 128, the latter being interrupted by a transverse annular inwardly opening groove having a frustoconical upper side wall 129 which constitutes a load-bearing shoulder and slants downwardly and outwardly at 45°. Male unit 123 has a transverse annular outwardly opening groove 130 in which is slidably disposed a resilient metal split ring 131 having an upper frustoconical surface 132 which tapers upwardly and inwardly at 45°. The ring is so dimensioned that, when groove 130 opposes the groove in the female unit, the ring can assume its relaxed and undistorted condition, with surface 132 in flush engagement with shoulder 129, a substantial portion of the ring still being engaged in groove 130 so that the ring is engaged between shoulder 129 and the bottom wall of groove 130 to prevent upward movement of unit 123, and thus pipe string 120, relative to unit 124 and structure 121 so long as the ring remains thus engaged. Ring 131 also has a downwardly and inwardly tapering frustoconical surface 133 which is exposed when the ring is relaxed. Below groove 130, male unit 123 is slidably embraced by a sleeve 134 and also has a circumferentially spaced series of male splines 135 on which sleeve 134 rests. Female unit 124 has a circumferentially spaced series of female splines 135*a*. The two sets of splines 135, 135*a* are so oriented and dimensioned that, when male unit 123 is in one rotational position relative to female unit 124, the male splines may pass downwardly through the respective spaces between the adjacent pairs of female spines, so that as the male unit moves downwardly surface 133 of the ring is first cammed inwardly by the lower side wall of the groove in the female unit, and sleeve 134 then engages the upper ends of female splines 135*a* so that continued downward movement of the male unit causes sleeve 134 to surround ring 131 and hold the ring in its retracted position so that the combination of string 120, male unit 123 and flex joint 125 can be withdrawn upwardly and recovered for, e.g., inspection.

Flex joint 125 comprises a first forked member 136 having its stem secured rigidly to male unit 123, a second forked member 137 the stem of which is secured rigidly to the lower end of pipe string 120, and universal joint means in the form of crossed shafts 138 and 139, the ends of shaft 138 being journalled in the respective ends of the two arms 136*a* of member 136 and extending therebeyond, the ends of shaft 139 being journalled in the respective ends of the two arms 137*a* of member 137. Shafts 138, 139 are secured together rigidly at their midpoints. The outer surfaces of the two arms 136*a* of member 136 are parts of a right cylindrical surface concentric with the longitudinal axis of male unit 123, as best seen in FIG. 3.

The flex joint is completed by a metal ring 140 which is made in two halves and bolted together, as seen in FIG. 3, so as to surround and be carried by the two arms 136*a* of member 136. The inner surface of the ring is right cylindrical and embraces the outer surfaces of arms 136*a*, two diametrically opposed longitudinal slots 141 being provided to accommodate the respective projecting ends of shaft 138. As seen in FIG. 2, slots 141 are closed at their upper ends so that, while the flex joint is free to move axially relative to ring 140 to an extent determined by the length of the slots, ring 140 is retained on and carried by flex joint member 136. The outer surface 142 of ring 140 is frustoconical, slanting downwardly and inwardly at the same angle as does upper bore portion 127.

Accordingly, the combination of male unit 123, flex joint 125 and pipe string 120 can be lowered with the aid of a conventional guidance system (not shown) until male unit 123 enters female unit 124 and reaches a point at which ring 131 springs outwardly to engage in the surrounding groove in the female member. As ring 131 approaches the groove in the female unit, the flex joint also enters the bore of the female unit. Ring 140 is spaced a substantial distance above ring 131, that spacing being such that, once ring 131 has reached its engaged position, ring 140 is lightly embraced by upper bore portion 27. With the parts thus disposed, male splines 135 are also lightly embraced by the surrounding cylindrical portion of the bore of the female unit. Thus, assuming tension is applied to pipe string 120, shoulder 129 and surface 132 are in flush load-bearing engagement, surface 142 of ring 140 is lightly embraced by the female unit at a substantial distance above split ring 131, and the outer surfaces of male splines 135 are lightly embraced by the female unit at a significant distance below the split ring. Hence, outer surface 142 of ring 140 serves as a stop surface which limits lateral movement of lower flex joint member 136 relative to female unit 124. Similarly, the outer surfaces of male splines 135 serve as stop surfaces to limit lateral movement of the male connector unit relative to the female unit. Since the diametrical fit between the bore wall of the female unit, on the one hand, and stop surface 142, on the other hand, is a loose fit, e.g., with a diameter difference of 0.005–0.02 inch, the combination of male connector unit 123 and flex joint member 136 has only a minimal, essentially insignificant freedom to move laterally in response to lateral loads applied via the flex joint. However, since the diametrical fits at the two stop surfaces are not tighter than a sliding fit, the freedom to rotate the male connector unit by rotating the pipe string, so as to bring male splines 135 into alignment with the respective spaces between the female splines, is preserved. Advantageously, the space between stop surface 142 and bore wall portion 127, and the space between male splines 135 and the surrounding bore wall, are made as small as possible without interfering with downward movement of male unit 123 within the female unit as the connector is made up. In this connection, it will be noted that ring 140 is generally wedge-shaped and, being of considerable weight, tends to gravitate and fill the space between arms 136*a* and bore wall portion 127, and that the upper ends of slots 141 can be so positioned as to assure that, when ring 140 is stopped by engagement of shaft 138 with the upper ends of slots 141, a specific minimized clearance between stop surface 142 and surrounding bore wall portion 127 will have been established. Best results will be obtained if male splines 135 are so dimensioned that, when the parts are positioned as seen in FIG. 2, there is less space between the male splines and the bore wall portion surrounding them than between stop surface 142 and bore wall portion 127 since, if shoulder 129 be considered as establishing a possible pivot point for the combination of unit 123 and flex joint member 136, the moment arm for stop surface 142 is long in comparison to that for the male splines.

From the foregoing, it will be apparent that, once connector 122 has been made up and pipe string 120 is under tension, at least the major part of any lateral force applied via flex joint member 137 is immediately transferred to female unit 124 via member 137, crossed shafts 138, 139, arms 136*a* of flex joint member 136, and ring 140. Such transfer is in parallel with the engagement of shoulder 129 and split ring 131 so that little of the lateral force can act through those engaged surfaces. Further, any bending or pivoting moments tending to result from such a lateral force are immediately opposed by the joint action of ring 140 and male splines 135. On the other hand, freedom of universal pivoting of flex joint member 137 is preserved, and while member 136 is constrained by ring 140 against pivotal movement, member 136 is free to rotate when member 137 is rotated by manipulating the pipe string.

Figure 4:
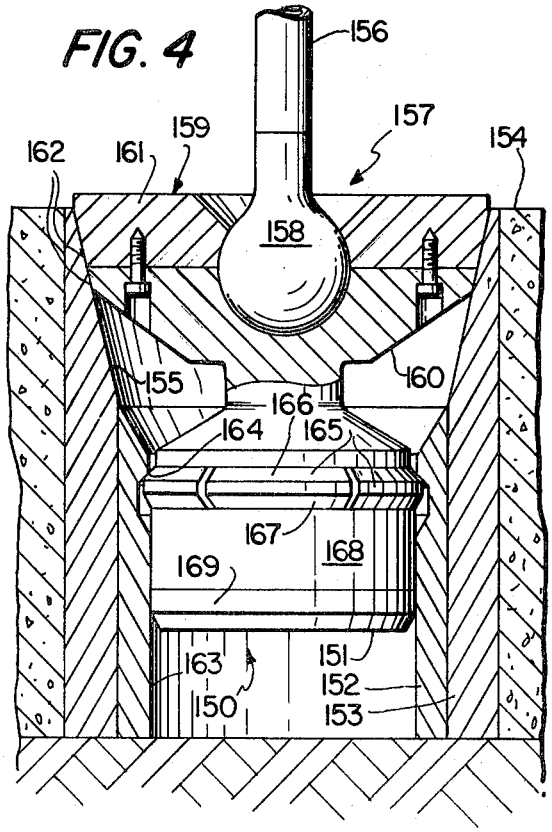

The embodiment shown in FIG. 4 illustrates the fact that the stop surface carried by the flex joint can cooperate with any surrounding rigid surface secured to the fixed underwater structure and that that stop surface can be a surface of the lower flex joint member itself. Here, connector 150 includes a male unit 151 and a tubular female unit 152, the latter being embraced by a receptacle 153 secured to the underwater structure 154. Receptacle 153 projects above the upper end of unit 152 so as to present a frustoconical inner surface portion 155 which tapers downwardly and inwardly at a small angle. Male connector unit 151 is connected to pipe string 156 by a ball and socket type flex joint 157 comprising a ball member 158, secured rigidly to the lower end of the pipe string, and a socket member 159 having a lower portion 160 rigidly secured to the male connector unit and an upper portion 161 secured rigidly to portion 160, as by screws as shown. Portions 160, 161 combine to present an outer frustoconical stop surface 162 which tapers downwardly and inwardly at the same angle as does surface portion 155 of receptacle 153.

Female unit 152 has a right cylindrical inner surface 163 interrupted by a transverse annular inwardly opening groove having a frustoconical upper wall or shoulder 164 which tapers downwardly and inwardly. Male unit 151 has a transverse annular outwardly opening groove accommodating a plurality of arcuate locking segments 165 arranged in an annular series and each having a frustoconical upper surface 166, adapted for flush engagement with shoulder 164, and a frustoconical lower surface 167 which slants downwardly and inwardly. Segments 165 are spring urged outwardly so that, when male unit 151 is positioned as shown, the segments are urged outwardly into the groove of the female unit to cause segment surfaces 166 to engage beneath shoulder 164. Immediately below segments 165, the male unit carries an annular piston 168 which can be driven upwardly by fluid pressure, as described for example in application Ser. No. 170,970, to first retract, then embrace the segments to hold them retracted. Below the piston, male unit 151 presents a transverse annular outwardly directed stop surface 169 which is slidably embraced by the surrounding bore wall of female unit 152 when the connector has been made up.

When connector 150 has been made up as shown in FIG. 4, the greater part of any lateral force applied via ball member 158 is transferred directly to receptacle 153, and thus to fixed structure 154, by contact of annular stop surface 162 of lower flex joint member 159 with bore wall portion 155 of structure 154. Essentially simultaneously with contact of surfaces 162 and 165, the lower stop surface 169 contacts the surrounding bore wall 163 of the female connector unit in load-bearing fashion. If the lateral force applied via flex joint member 158 includes a bending or pivoting moment, any tendency for male connector unit 151 to pivot is stopped immediately by contact of upper stop surface 162 with receptacle surface 155 and contact of lower stop surface 169 with surface 163 of the female unit. Though the male connector unit cannot be rotated by manipulating the pipe string, such rotation is unnecessary since the male unit requires no rotational orientation relative to the female unit.

Figure 5:
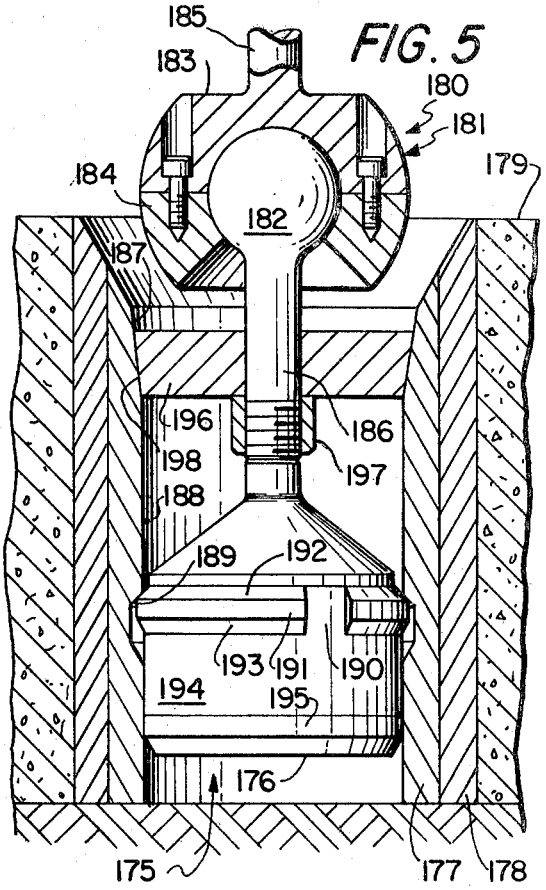
FIGS. 4–6 are semidiagrammatic views similar to FIG. 2 and each illustrating another embodiment of the apparatus.

FIG. 5 shows that the orientation of a ball and socket flex joint can be reversed and a stop surface still provided on the lower flex joint member according to the invention. In this embodiment, connector 175 includes male connector unit 176 and tubular female unit 177, the latter being embraced by and secured to a tubular receptacle 178 which is in turn fixed to underwater structure 179. Male unit 179 is connected to the pipe string (not shown) by a ball and socket type flex joint 180 comprising an upper socket member 181 and a lower ball member 182. Member 181 is made up of two portions 183, 184 secured together, as by screws, upper portion 183 including a stem 185 secured rigidly to the lower end of the pipe string. Lower member 184 includes an elongated stem 186 secured rigidly to the male connector unit 176.

Female connector unit 177 has an upper bore wall portion 187 which is frustoconical and tapers downwardly and inwardly at a small angle. Below portion 187, the inner surface 188 of unit 177 is right cylindrical and is interrupted by a transverse annular inwardly opening groove the frustoconical upper wall 189 of which constitutes a load-bearing shoulder which tapers upwardly and inwardly at 45°. Male unit 176 has a transverse annular outwardy opening groove 190 in which is disposed a resilient metal split ring 191 having a frustoconical upper surface 192 which tapers upwardly and inwardly at the same angle as does shoulder 189 so that, when the connector units are in the relative positions shown, ring 191 can expand outwardly to its relaxed position to engage surface 192 beneath shoulder 189. Ring 191 also has a frutoconical lower surface 193 which tapers downwardly and inwardly. Immediately below groove 190, the male unit carries an annular piston 194 which can be driven upwardly by pressure fluid supplied via the pipe string and which will then engage surface 193 to retract ring 191 and embrace the ring to retain it in retracted position so the pipe string, flex joint and male connector unit can be recovered. Below piston 194, the male unit has a transverse annular outwardly directed stop surface 195 slidably embraced by surface 188 when the connector is made up.

Lower flex joint member 182 carries a stop member 196 in the form of a circular plate having a central through bore which slidably embraces stem 186, the lower end portion of the stem being threaded and a nut 197 being provided to support member 196 as shown. Outer surface 198 of member 196 is frustoconical and tapers downwardly and inwardly at the same angle as does inner surface portion 187 of the female connector unit, the diameter of surface 198 being such that, when connector 175 has been made up, member 196 is disposed with surface 198 in flush engagement with surface portion 187. Surface 198 thus constitutes the stop surface carried by the lower flex joint member.

Operation of the embodiment shown in FIG. 5 is essentially the same as that shown in FIG. 4 except that, since member 196 is slidable on stem 186, the male connector unit can be moved downwardly, during make-up of the connector, after stop surface 198 has come into flush engagement with surface portion 187.

Figure 6:
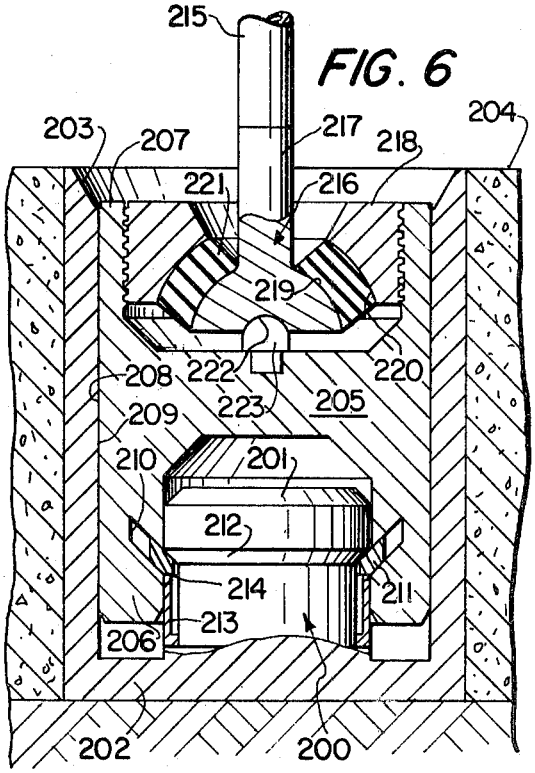

FIG. 6 shows that the female connector unit, rather than the male unit, can be connected to the flex joint, and that the lower flex joint member can be integral with the connector unit. Here, connector 200 comprises a fixed upright male connector unit 201 which is rigidly mounted on base plate 202 of an upright tubular receptacle 203, the receptacle being concentric with and spaced outwardly from the male connector unit and secured rigidly to the fixed underwater structure 204. Female connector unit 205 comprises a dependent tubular portion 206, dimensioned to slidably embrace male connector unit 201, and an upstanding tubular portion 207. The female unit has a continuous right cylindrical outer surface 208 which extends from the lower end of portion 206 to the upper end of portion 207 and is dimensioned to be slidably embraced by inner surface 209 of receptacle 203.

Portion 206 of the female unit has a transverse annular inwardly opening groove 210 including parallel frustoconical side walls which taper downwardly and inwardly at 45° to slidably retain a resilient metal split ring 211. Male unit 201 has a transverse annular downwardly directed shoulder 212 which tapers downwardly and inwardly at 45° so as to coact with the upper face of ring 211 when the ring is in its relaxed position and therefore projects inwardly from groove 210 as shown. For remote retraction of the ring, unit 201 is equipped with an annular piston 213 which can be driven upwardly to cause the upper end of the piston to engage a lower surface 214 on the ring and cam the ring outwardly, so disengaging ring 211 from beneath shoulder 212.

Female unit 205 is connected to pipe string 215 by the flex joint indicated generally at 216 and comprising upper flex joint member 217. The lower flex joint member comprises a ring 218 and the upstanding tubular portion 207 of the female connector unit, ring 218 being connected to portion 207 by internal threads on portion 207 which coact with external threads on ring 218, as shown. The lower end portion of upper flex joint member 217 is enlarged and presents an upwardly facing convex surface 219 opposed to and concentric with the concave lower surface 220 of ring 218. The space between convex surface 219 and concave surface 220 is filled by a body 221 of elastomeric material bonded to the two surfaces 219, 220. The lower end of member 217 has a concave surface 222 seated on a ball member 223 supported by the body of unit 205, as shown.

Lateral forces applied by pipe string 215 to upper flex joint member 217 are transferred through elastomeric material 227 to the combination of ring 218 and the upper tubular extension 207 of female connector unit 205, with the result that outer surface 208 of the female connector unit is immediately brought into lateral load-bearing contact with inner surface 209 of receptacle 203, so that the lateral force is transmitted to the receptacle and therefore to the fixed underwater structure 204. In this embodiment, the entire outer surface 208 of female unit 205 constitutes the stop surface for transmitting lateral forces mainly in parallel with, rather than through, the interengaged surfaces of connector 200.

THE EMBODIMENT OF FIGS. 7 AND 8

Figure 7:
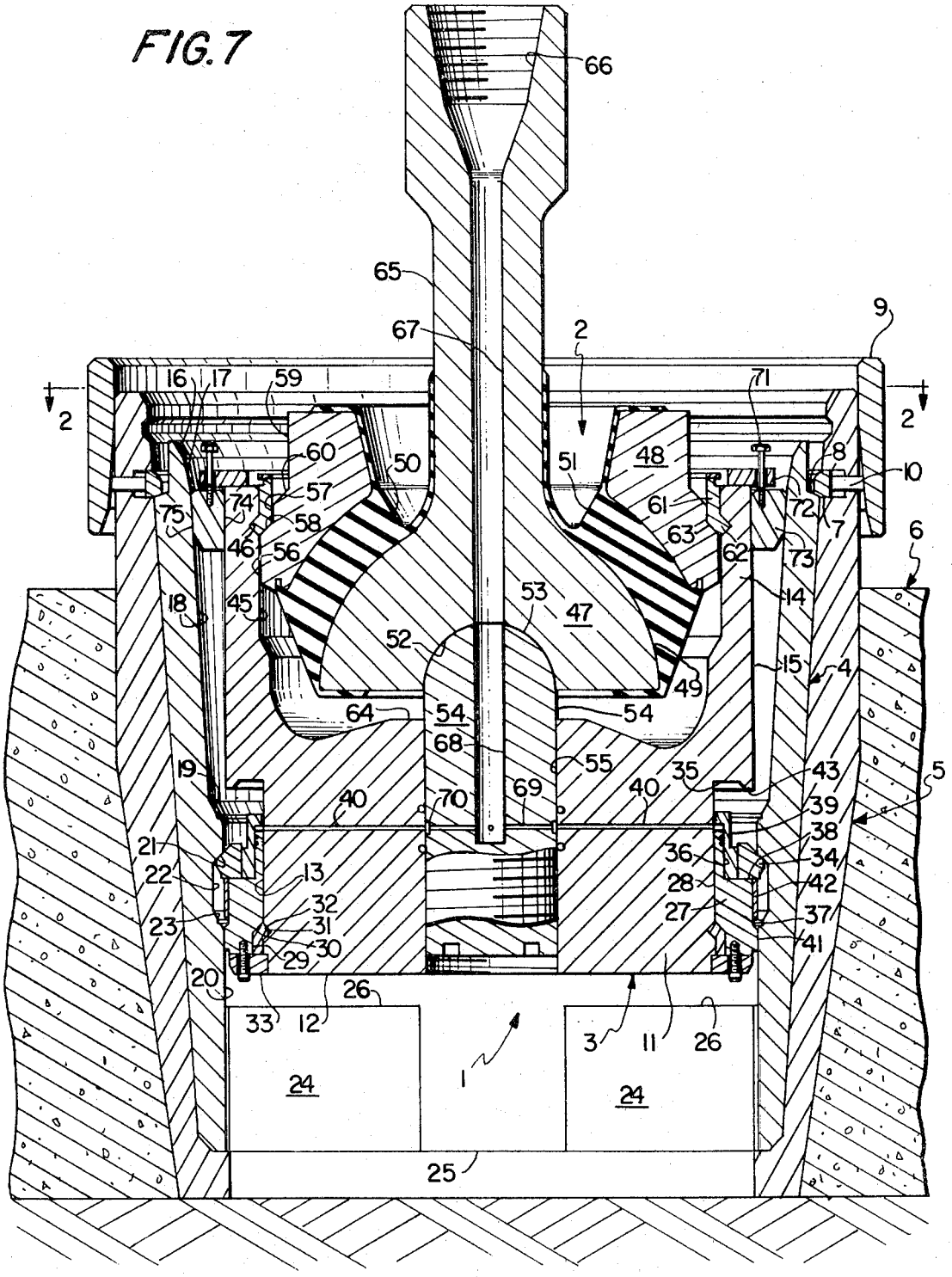
FIG. 7 is a vertical sectional view on larger scale than FIGS. 2–6 and showing in detail a particularly advantageous embodiment of the apparatus.
Figure 8:
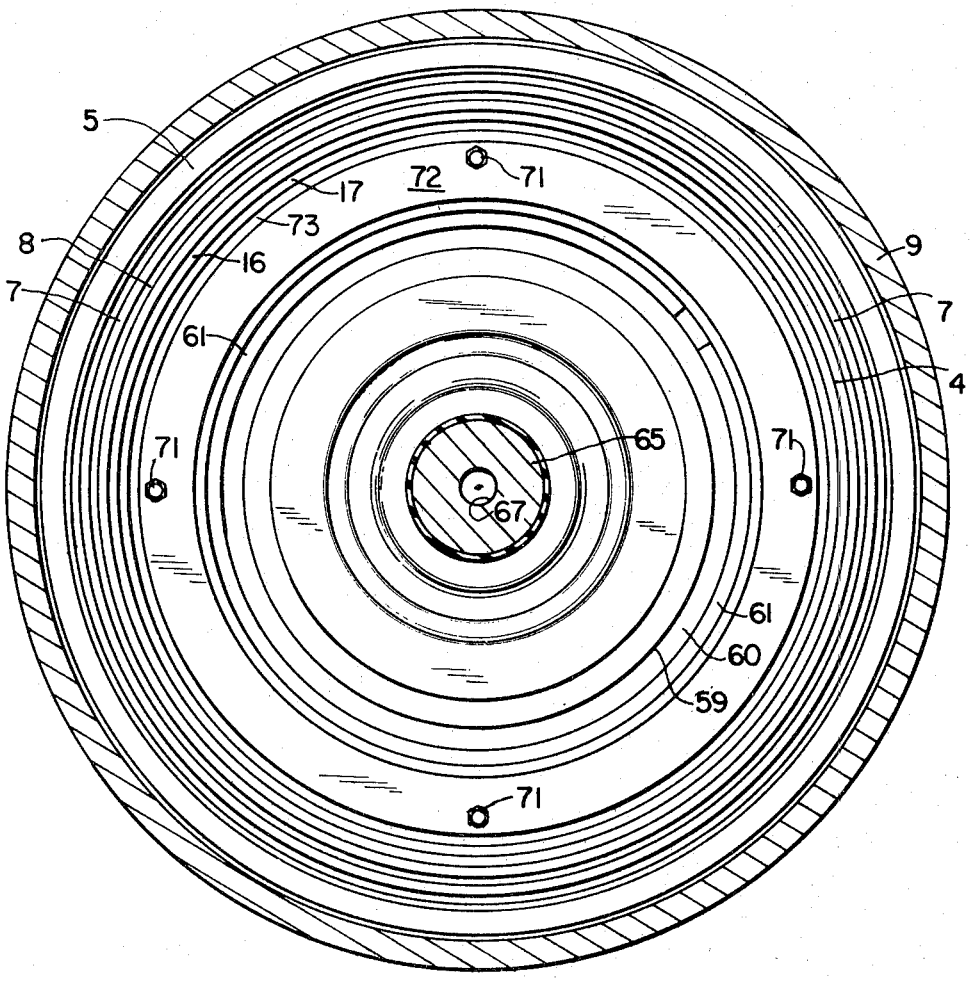
FIG. 8 is a transverse sectional view taken generally on line 8—8, FIG. 7.

FIGS. 7 and 8 illustrate a preferred embodiment of the invention which comprises a remotely connectable and releasable connector, indicated generally at 1, combined with a flex joint, indicated generally at 2. Connector 1 is constructed generally in accordance with aforementioned application Ser. No. 170,970 and comprises a male connector member 3, shown landed and connected to the cooperating tubular female connector member 4, the latter being retained in a tubular receptacle 5 secured to the anchoring base 6 in any suitable fashion. The lower end of female member 4 is shouldered on receptacle 5, as shown, and the female member is locked in place, as by a split ring 7 forced inwardly to engage over a shoulder 8 on the female member by a camming ring 9 acting on push pins 10.

Male connector member 3 includes an integral main body 11 of metal, the body having a lower end 12, an intermediate portion having a right cylindrical outer surface portion 13, and an annular upper end portion 14 which presents a right cylindrical outer surface portion 15.

Female connector member 4 has at its upper end a short frustoconical inner surface portion 16 which tapers sharply downwardly and inwardly, a second frustoconical surface portion 17 tapering downwardly at a smaller angle than does portion 16, and a third frustoconical surface portion 18 tapering downwardly at a still smaller angle. Surface portion 18 is elongated and at its lower end joins a frustoconical guide surface 19 which tapers downwardly and inwardly at, e.g., 30° relative to the longitudinal axis of the connector. Surface 19 joins a right cylindrical inner surface 20 which extends to the lower end of female member 4. Below surface 19, surface 20 is interrupted by a transverse annular inwardly opening groove defined by an upper load-bearing shoulder 21, a cylindrical wall 22, and a lower frustoconical shoulder 23 which is identical to surface 19. Shoulder 21 is frustoconical, tapering upwardly and inwardly, advantageously at 45°. A predetermined distance below shoulder 23, surface 20 is interrupted by three splines 24 which are spaced apart circumferentially to define three guideways 25. Splines 25 have upper end shoulders 26 which lie in a common plane at right angles to the longitudinal axis of the coupling.

Outer surface portion 13 of body 11 is of substantially smaller diameter than is surface 20 of member 4 so that an annular body 27 can be accommodated between surfaces 13 and 20 when the parts are in the relative positions seen in FIG. 7. Body 27 has a right cylindrical inner surface 28 which slidably embraces surface 13. At its lower end, body 27 has a right cylindrical inner surface portion 29 and a frustoconical shoulder 30 which tapers upwardy and inwardly at 45° and joins surfaces 28 and 29. Body 11 has a transverse annular groove 31 which is of right triangular radial cross section so as to present a 45° frustoconical shoulder opposed to shoulder 30. A split ring 32 is engaged in groove 31 and has a 45° shoulder engaged by shoulder 30 to accept forces tending to move body 27 downwardly relative to body 11, relative movement in the opposite direction being prevented by a stop ring 33 bolted to the lower end of body 27 and shouldered on body 11, all as described in detail in aforementioned application Ser. No. 120,046.

Thus secured to main body 11, annular body 27 constitutes the male carrier for a split ring 34 of remotely operated connector means constructed in the manner described and claimed in aforementioned application Ser. No. 170,970. Body 27 is axially shorter than surface 13 so that there is a substantial space between the upper end of body 27 and the downwardly facing transverse annular shoulder 35 which joins surfaces 13 and 15. The upper end portion of body 27 has a right cylindrical outer surface 36 of substantially smaller diameter than surface 20. The remainder of body 27 has a larger right cylindrical outer surface 37, surfaces 36, 37 being concentric with surface 28 and joined by a flat transverse annular upwardly facing shoulder 38. Described in detail in application Ser. No. 170,970, ring 34 has upper and lower frustoconical outer surfaces to coact with shoulders 21 and 23, respectively, and a flat lower surface which can slidably engage shoulder 38, as seen in FIG. 7, so that ring 34 can be engaged between shoulders 21 and 38 to transfer tension loads from the male connector member to the female connector member. Ring 34 also has a right cylindrical inner surface, and when the resilient ring is in its relaxed and undistorted condition, substantially as seen in FIG. 7, that inner surface is spaced outwardly from surface 36. To prevent ring 34 from being cammed inwardly by interaction between the ring and shoulder 21 when the connector is under a tension load, an annular blocking piston 39 is provided which has a lower portion capable of filling the annular space between surface 36 and ring 34 when the parts are in the positions seen in FIG. 7. Piston 39 slidably embraces surfaces 13 and 36 and coacts with bodies 11 and 27 to define an expansible chamber to which pressure fluid can be supplied via ducts 40 to drive the piston upwardly, freeing ring 34 to move inwardly when the connector is to be released in the manners described in detail in application Ser. No. 170,970.

The diameter of surface 37 is smaller than that of surface 20 by an amount such that surface 37 can be embraced by female splines 24. However, in a location spaced below shoulder 38, surface 37 is interrupted by three arcuate, circumferentially spaced, outwardly projecting splines 41. Splines 41 are so dimensioned and positioned as to be capable of entering the respective guideways 25 only when body 27 is in one predetermined rotational position relative to female connector member 4. Between shoulder 38 and male splines 41, surface 37 is embraced by a retaining sleeve 42 employed during one mode of release of the coupling to retain ring 34 in a contracted position, achieved by coaction between ring 34 and shoulder 23, with the aid of a dependent annular camming lip 43, as the male connector member is moved downwardly with splines 41 registered with guideways 25.

Annular upper end portion 14 of male connector member 3 presents an axially elongated right cylindrical inner surface 45 interrupted near its upper end by a transverse annular inwardly opening groove 46 of right triangular radial cross section. Surrounded by surface 46, the flex joint 2 comprises a metal ball member 47 and a metal socket member 48. Member 47 has a convex spherical surface 49 and member 48 presents a concave spherical surface 50 of a larger radius of curvature than surface 49. Surfaces 49, 50 are spaced apart and the space therebetween is bridged by a body of elastomeric material 51 bonded to members 47, 48 in conventional fashion.

Member 47 also presents a downwardly opening concave spherical surface 52 which is concentric with surface 49 and dimensioned for flush sliding engagement with the convex spherical upper end surface 53 of a plug member 54 disposed in an axial bore 55 in main body 11 of male connector member 3. The lower end portions of plug member 54 and bore 55 are threaded so that the plug member can be retracted downwardly from the position shown in FIG. 7, preparatory to installation of members 47, 48.

Socket member 48 has a right cylindrical lower outer surface portion 56 of only slightly smaller diameter than inner surface 45 of portion 14 of body 11. Surface portion 56 is joined to a smaller diameter short cylindrical surface portion 57 by a frustoconical shoulder 58 which tapers upwardly and inwardly at 45°. Surface portion 57 is in turn joined to a still smaller diameter cylindrical surface portion 59 by upwardly and inwardly tapering shoulder 60. A split fastener ring 61 has a portion 62 of right triangular radial cross section engaged in groove 46, the fastener ring also presenting a frustoconical shoulder 63 which faces away from the upper wall of groove 46 and tapers upwardly and inwardly at the same angle as does that wall.

Below surface 45, body 11 is significantly recessed and includes a transverse upwardly directed surface 64 through which bore 55 opens. When the combination of members 47 and 48 is to be installed, plug member 54 is first retracted downwardly until, upon downward insertion of members 47 and 48, the lower end face of member 47 can be brought into contact with surface 64, bringing outer surface portion 57 of member 48 below groove 46. The resilient split fastener ring 61 is then retracted, inserted downwardly through the annular space between surfaces 45 and 59, and allowed to expand to its relaxed position, with portion 62 engaged in groove 46. Plug member 54 is then adjusted, via its threaded engagement in bore 55, until surfaces 52, 53 are engaged, shoulder 58 is engaged with shoulder 63, and elastomeric material 51 is under compression between members 47 and 48. With the parts thus interrelated, split fastener ring 61 serves to transfer tension loads from the flex joint to the male connector member in the manner more fully described in application Ser. No. 120,046.

Integral with member 47 is an upright stem 65 internally threaded at 66 for rigid attachment to the lowermost joint of the pipe string (not shown) to be connected to anchoring base 6. An axial bore 67 extends through member 47 and stem 66 to communicate between the bore of the pipe string and an axial blind bore 68 in plug 54. Near its blind end, bore 68 communicates with a plurality of radial bores 69 which open outwardly into a transverse annular outwardly opening groove 70 in the outer surface of plug member 54. With the plug member in its operative position, ducts 40 open inwardly into groove 70 and are thus in communication with the bore of the pipe string, via bores 67–69, so that pressure fluid supplied via the pipe string can operate to drive piston 39 to its uppermost position, freeing ring 34 to move inwardly and release the connector.

Surrounding upper end portion 14 of body 11, and loosely supported thereon by a circumferentially spaced series of bolts 71 extending freely through holes in a support ring 72 supported on the upper end of portion 14, is a wedge ring 73. Ring 73 has a right cylindrical inner surface 74 slidably embracing outer surface 15 of annular portion 14 of member 11. Outer surface 75 of ring 73 is frustoconical, tapering downwardly and inwardly at the same angle as does surface 18 of female member 4. When the combination of male connector member 3 and flex joint 2 is lowered into female connector member 4, outer surface 75 of ring 73 comes into sliding engagement with surface 18 of the female connector member and, as downward movement of the male connector member continues, becomes lightly wedged between surfaces 15 and 18 as ring 34 engages under shoulder 21. With the parts in these relative positions, the outer surfaces of male splines 41 are loosely embraced by surface 20, there being, e.g., a 0.005–0.02 inch space therebetween.

Once connector 1 has been made up as seen in FIG. 7, the entire tension load applied by the string of pipe connected to stem 65 is applied to female connector member 4, and hence to anchoring base 6, via split ring 34. When a lateral load is applied to the pipe string, a portion of the force from that load is transferred to annular portion 14 of body 11 via member 47, elastomeric material 51, member 48 and ring 61. The portion of the force thus applied to annular portion 14 is transferred to the upper portion of female connector member 4 via ring 73, in a location spaced well above ring 34. A portion of the force from the lateral load is also applied to the lower portion of body 11 via surfaces 52, 53 and plug member 54. This portion of the force causes one of male splines 41 to engage surrounding surface 20 of member 4, so that a portion of the force is applied to the female connector member in a location well below ring 34. The male connector member cannot be angularly displaced beyond that very small excursion allowed by the small annular space between male splines 41 and surface 20. Accordingly, while a portion of the force resulting from the lateral load is imparted to ring 34 via body 11, annular body 27 and blocking piston 39, this portion of the force can have at most a negligible tendency to disturb the engagement of ring 34, which carries the tension load, with shoulder 21.

Since member 47 is capable of pivoting on surface 53 of plug member 54, a lateral force applied to the pipe string to which stem 65 is attached can tend to cause body 11 of the male connector member to turn, about a horizontal axis, relative to the female connector member. Thus, if member 47 pivots to the right as viewed in FIG. 7, there is a resulting tendency for the upper end of body 11 to move to the left and the lower end to move to the right. But such movement of upper end portion 14 is immediately stopped by ring 73, while movement of the lower end is immediately stopped by engagement of one of the male splines 41 with surface 20. Accordingly, good direct transfer of forces from lateral loads to the female connector member, and thus to receptacle 5 and anchoring base 6, is achieved with a minimum possibility of adverse effect upon the tension load-carrying capacity of connector 1.

Since ring 72 is supported on but not secured to the upper end of annular upper end portion 14, the combination of male connector member 3 and flex joint 2 is free to be moved downwardly relative to female connector member 4 once male splines 41 have been aligned with the respective guideways 25 by manipulating the pipe string. Thus, wedging ring 73 does not interfere with secondary release of the connector in the manner described in application Ser. No. 170,970. Instead of the continuous ring 73, a plurality of circularly spaced arcuate wedge segments can be employed, each supported from ring 72 by one of the bolts 71. The upper end portion of surface 15, to be engaged by the inner surface of ring 73, can be frustoconical and taper upwardly and inwardly to increase the wedging action without reducing the freedom to move the male connector member downwardly for release.

What is claimed is:

1. In apparatus for connecting an elongated tension element to a fixed underwater structure with the tension element extending generally downwardly to the underwater structure, the combination of a male connector unit, a female connector unit, and connector means comprising a transverse annular shoulder carried by one of the male and female connector units, and generally annular stop means carried by the other of the male and female connector units, the shoulder and stop means being in mutual engagement and preventing upward movement of the elongated tension element relative to the connector units, one of the male and female connector units being connected to the elongated tension element, the other of the male and female connector units being secured to the fixed underwater structure;

rigid generally tubular means having a bore wall portion and being secured to the fixed underwater structure in a position in which the bore wall portion is concentric with the connector and spaced above the connector means; and flex joint means connected between the elongated tension element and the one of the male and female connector units which is connected thereto, the flex joint means comprising a first flex joint member rigidly connected to said one of the male and female connector units, a second flex joint member rigidly connected to the elongated tension element, universal joint means interconnecting the first and second flex joint members and transmitting tension loads from one flex joint member to the other; and rigid stop means including a generally annular outwardly directed stop surface surrounding and carried by the flex joint means in a location spaced substantially above the connector means, the rigid stop means being rigidly carried by the flex joint means and preventing significant lateral movement of the rigid stop means relative to the flex joint means, and the annular stop surface being so closely embraced by the bore wall portion that lateral forces applied to the flex joint means by the tension element are transferred to the fixed underwater structure via direct engagement between the rigid stop means and the bore wall portion without occurrence of substantial relative movement between the shoulder and stop means of the connector means.

2. The combination defined by claim 1, wherein:

the annular stop surface of the flex joint means is carried by the first flex joint member.

3. The combination defined by claim 2, wherein:

the first flex joint member is connected to the connector unit by rigid means which is axially long in comparison to the axial dimension of the annular stop means of the connector means.

4. The combination defined by claim 1, wherein:

the universal joint means is of the ball-and-socket type, one of the first and second flex joint members carrying a convex surface, the other of the first and second flex joint members carrying a concave surface, the convex and concave surfaces being at least generally concentric and mutually opposed, the rigid stop means being a ring which embraces a portion of the first flex joint member and is carried thereby.

5. The combination defined in claim 1, wherein:

the rigid means including the stop surface is integral with the one of the connector units to which the first flex joint member is adapted to be connected.

6. The combination defined in claim 1, wherein:

the first flex joint member is adapted to be connected to the male connector unit.

7. The combination defined in claim 1, wherein:

the first flex joint member is adapted to be connected to the female connector unit.

8. The combination defined in claim 1, wherein:

the rigid generally tubular means comprises a second bore wall portion located below the connector means; and the one of the connector units to which the first flex joint member is connected includes a second generally annular outwardly directed stop surface located below the connector means and so closely embraced by the second bore wall portion of the rigid generally tubular means that a lateral force transferred to said one of the connector units by the flex joint means to bias laterally that portion of said one connector unit which is below the connector means causes engagement of the second generally annular outwardly directed stop surface with the second bore wall portion before such force causes substantial relative movement between the shoulder and stop means of the connector means.

9. The combination defined in claim 1, wherein:

the rigid generally tubular means is part of the female connector unit.

10. The combination defined in claim 1, wherein:

the rigid generally tubular means comprises a member in addition to the female connector unit and the bore wall portion is located above the female connector unit.

11. The combination defined by claim 1, wherein:

the bore wall portion of the rigid generally tubular means is frustoconical and tapers downwardly and inwardly at a small angle; and the generally annular outwardly directed stop surface of the rigid stop means of the flex joint means is generally frustoconical and tapers downwardly and inwardly at the same angle as does said bore wall portion.

12. The combination defined by claim 1, wherein:

the bore wall portion of the rigid generally tubular means slidably embraces the outwardly directed stop surface of the rigid stop means when the shoulder and stop means of the connector means are mutually engaged.

13. The combination defined by claim 11, wherein:

the first-mentioned bore wall portion is frustoconical and tapers downwardly and inwardly at a small angle; and the outwardly directed stop surface of the rigid stop means is frustoconical and tapers downwardly and inwardly at the same angle as does the first-mentioned bore wall portion.

14. The combination defined by claim 13, wherein:

the second bore wall portion is cylindrical.

* * * * *